US006959508B2

(12) United States Patent
Watkins et al.

(10) Patent No.: US 6,959,508 B2
(45) Date of Patent: Nov. 1, 2005

(54) ARRANGEMENT FOR STORING AND/OR ORGANIZING PHOTOGRAPHIC PRODUCTS

(75) Inventors: Rachel Watkins, Cumming, GA (US); Susan A. Clark, Atlanta, GA (US); Renee L. Schlosberg, Kennewaw, GA (US); Jeffrey M. Fishel, King, NC (US); John K. Hollingsworth, Mount Airy, NC (US); Joseph C. Whitman, Winston-Salem, NC (US); Gene A. Kraft, Rural Hall, NC (US); John D. Woodlief, King, NC (US)

(73) Assignee: Eastman Kodak Company, Rochester, NY (US)

( * ) Notice: Subject to any disclaimer, the term of this patent is extended or adjusted under 35 U.S.C. 154(b) by 3 days.

(21) Appl. No.: 10/600,214

(22) Filed: Jun. 20, 2003

(65) Prior Publication Data

US 2004/0255495 A1 Dec. 23, 2004

(51) Int. Cl.[7] ..... G09F 23/10
(52) U.S. Cl. ..... 40/641; 206/455
(58) Field of Search ..... 40/641, 359; 206/455; 229/71, 72

(56) References Cited

U.S. PATENT DOCUMENTS

| | | | | | |
|---|---|---|---|---|---|
| 35,861 | A | | 7/1862 | Wilson | |
| 1,177,886 | A | * | 4/1916 | Newcomb | 283/116 |
| 1,303,968 | A | * | 5/1919 | Sawdon | 229/72 |
| 3,365,117 | A | * | 1/1968 | Powell, Jr. | 229/71 |
| 4,047,661 | A | * | 9/1977 | Klein | 229/72 |
| 4,545,486 | A | | 10/1985 | Bostic | |
| 4,720,733 | A | | 1/1988 | Ohtake et al. | |
| 4,854,464 | A | * | 8/1989 | Kim | 206/455 |
| 4,932,529 | A | | 6/1990 | Levine | |
| 4,958,855 | A | | 9/1990 | Shipp | |
| 4,966,285 | A | | 10/1990 | Otake et al. | |
| 5,251,744 | A | * | 10/1993 | Dziersk et al. | 206/455 |
| 5,431,449 | A | | 7/1995 | Arimoto et al. | |
| 5,816,392 | A | | 10/1998 | Kawagoe et al. | |
| 5,988,372 | A | | 11/1999 | Kawagoe et al. | |
| 6,024,278 | A | | 2/2000 | Martin | |
| 6,145,882 | A | | 11/2000 | Fu | |
| 2003/0144923 | A1 | * | 7/2003 | Capozzi et al. | 705/26 |

* cited by examiner

*Primary Examiner*—Gary C. Hoge
(74) *Attorney, Agent, or Firm*—David A. Novais

(57) ABSTRACT

The present invention relates to an arrangement for storing at least photographic prints. The arrangement of the present invention is in the form of an envelope or wallet-type member and includes a tab arrangement which permits a user to customize the location of the tabs on the wallet-type member. The tab arrangement comprises removable tabs on the wallet-type member which provides a customer with the opportunity to chose which tab is to be used for providing identifying information on the envelope. Further, the wallet-type member includes a planar member which is adapted to have an opening to reveal an index print or a photographic print representative of the prints stored in the wallet-type member. The opening and the tab or tabs are provided on the same side or the same planar member of the wallet-type member so as to enable the viewing of both the tab or tabs and the displayed index or photographic print at the same time.

34 Claims, 4 Drawing Sheets

ARRANGEMENT FOR STORING AND/OR ORGANIZING PHOTOGRAPHIC PRODUCTS

FIELD OF THE INVENTION

The present invention relates to a holder or arrangement for storing and/or organizing photographic products such as photographic prints and negatives. The holder or arrangement of the present invention is in the form of an envelope or wallet-type member that includes a tab for identifying the contents of the wallet-type member. The envelope or wallet-type member is adapted to store photographic prints and display a selected photographic print representative of the stored photographic prints through a hole or window provided on the wallet-type member.

BACKGROUND OF THE INVENTION

Typically, when a customer desires to process a roll of photographic film, the customer delivers his/her exposed film to a photofinisher who processes the film and in due course returns to the customer a package containing the finished photographic prints and their corresponding negatives. The type of package delivered by the photofinisher is typically an envelope or wallet-type member that is known in the industry as a wallet. The wallet is constructed to hold the photographic prints and further may include a sleeve or pocket for holding negatives.

In traditional photographic wallets, it is difficult to distinguish the content of one wallet from another wallet since these wallets do not provide for a way to visually identify the subject matter of the photographic prints in the wallet in combination with a way to visually display an index print or a photographic print that is representative of the photographic prints in the wallet.

U.S. Pat. No. 6,024,278 discloses a mailable envelope arrangement utilized for advertising materials. In U.S. Pat. No. 6,024,278, a window is provided on the envelope for identifying the nature of the contents within the envelope and separator tabs are adapted to be inserted within the envelope. However, in U.S. Pat. No. 6,024,278, the separator tabs are provided as separate elements within the envelope and, therefore, there is no way to see the tabs from outside the when the envelope is closed. Further, when the envelope is closed, U.S. Pat. No. 6,024,278 does not permit a viewing of both the tab and the material that is displayed within an opening in the envelope.

U.S. Pat. No. 5,988,372 discloses an arrangement or wallet for holding photographic prints. However, in the arrangement of U.S. Pat. No. 5,988,372, a single tab forms an integral part of the planar wall of the arrangement and is provided at a corner of the arrangement. Further, in U.S. Pat. No. 5,988,372, the single tab is basically for use by the photofinisher in identifying the customer order. When storing a plurality of photographic wallets or wallet-type members within a storage box in an adjacent manner, it is advantageous that the tabs do not line up one behind the other, in order to facilitate the viewing of the tabs. In U.S. Pat. No. 5,988,372, the single tab is disclosed at the corner of the wallet and there is no provision for a customer to select the desired location of the tab based on where the customer would like to store the wallet.

What is needed is a holder for photographic products which gives the customer flexibility with respect to the location of an identifying tab. What is also needed is a holder for photographic products such as photographic prints which includes a tab and an opening or window on a wallet which permits the user to view both the tab and the opening or window at the same time. This permits a user to both distinguish the content of the photographic prints within the wallet through the use of the tab, and identify the nature of the photographic prints stored in the wallet by way of an index print or a representative print which is viewed or displayed through the opening or window.

SUMMARY OF THE INVENTION

The present invention provides for a unique holder or arrangement for storing, organizing and locating photographic products such as photographic prints and negative. The arrangement of the present invention permits a customer's photographic prints to be returned in an envelope or wallet-type member that can have a clear plastic window and an opening through which a customer can see their first picture or an index print. The arrangement of the present invention further includes a tab that permits a customer to label the wallet-type member. In a feature of the tab of the present invention, at least two tabs and preferably four tabs can be provided on the wallet and can be removable by way of a perforated or tear line. This permits a customer to select the location of the tab on the wallet-type member and thus, permits the insertion of the photographic wallet-type member into a storage box in a manner in which the identification of multiple wallet-type members lined up one behind the other is facilitated.

The present invention accordingly relates to a holder for holding at least photographic prints. The holder comprises a first planar member attached to a second planer member through a first fold line; first and second expandable end member at side ends of the first and second planar members, such that the first and second planar members and the first and second expandable end members define an enclosure for holding at least photographic prints; a storage slot sized to receive and hold negatives therein, with the storage slot being attached to an end of the second planar member so as to hang over an outer surface of the second planar member; and at least two tabs attached to a top end of the first planar member; wherein a first perforated line is defined between the top end of the first planar member and the at least two tabs to permit a removal of each of the tabs from the top end of the first planar member.

The present invention further relates to an arrangement for holding photographic products which comprises a first holding area for holding a first type of photographic product, with the first holding area having a first planar member and a second planar member; and at least two tabs removably provided on one of the first and second planar members of the first holding area.

The present invention further relates to a method of storing and organizing at least photographic prints which comprises the steps of inserting photographic prints into a first holding area defined by at least first and second planar members; and placing at least two tabs at an end of one of the first and second planar members, wherein a first tear line is provided between the at least two tabs and the end of the one of the first and second planar members to permit a removal of a selected one of the tabs, with the tabs being sized to permit the addition of identifying information thereon, and the identifying information being related to at least the photographic prints held in the first holding area.

The present invention further relates to an arrangement for storing and organizing at least photographic prints, with the arrangement comprising a storage member adapted to store photographic prints, with the storage member comprising a planar member having at least one tab extending therefrom; and a removable portion on the planar member which is removable to form an opening in the planar member, with the opening being sized to permit a viewing of a photographic print in the storage member.

The present invention further relates to an arrangement for storing and organizing at least photographic prints which comprises a holding section adapted to store photographic prints, with the holding section comprising at least two tabs removably provided on the holding section; and a transparent window provided on the holding section, with the transparent window forming a pocket on the holding section to permit a viewing of a photographic print inserted in the pocket.

The present invention further relates to an arrangement for storing and organizing at least photographic prints which comprises a storing section adapted to store the photographic prints, with the storing section comprising at least two tabs removably provided on the storing section; and a removable portion on a planar member of the storing section, with the portion being removable to form an opening in the planar member, and the opening being sized to permit a viewing of a photographic print in the storage section.

The present invention further relates to an arrangement for storing and organizing at least photographic prints which comprises a wallet-type member adapted to store the photographic prints, with the wallet-type member comprising at least two tabs removably provided on the wallet-type member; and an opening provided on a planar member of the wallet-type member with the opening being sized to permit a viewing of a photographic print in the wallet-type member through the opening.

The present invention further relates to a method of delivering at least photographic prints to a customer which comprises the steps of inserting photographic prints into a wallet-type member; and placing at least two tabs at a top end of the wallet-type member, wherein a first tear line is provided between the at least two tabs and the top end of the wallet-type member to permit a removal of a selected one of the tabs, and the tabs are sized to permit the addition of identifying information thereon by the customer, with the identifying information being related to the photographic prints held in the wallet-type member.

The present invention further relates to a method of delivering at least photographic prints to a customer which comprises the steps of inserting photographic prints into a wallet-type member; and permitting a visual display of one of the photographic prints in the wallet-type member by providing a removable portion on a planar member of the wallet-type member, with the removable portion being surrounded by a tear line and permitting the removal of the portion by the customer to form an opening in the planar member. The opening is sized to permit the visual display of a photographic print in the wallet-type member.

The present invention further relates to a holder adapted to hold at least photographic prints which comprises a wallet-type member adapted to hold photographic prints; and a removable portion on a planar member of the wallet-type member, with the removable portion being removable to form an opening in the planar member, and the opening being sized to permit a viewing of a photographic print in the wallet-type member.

DETAILED DESCRIPTION OF THE INVENTION

Figure 1:
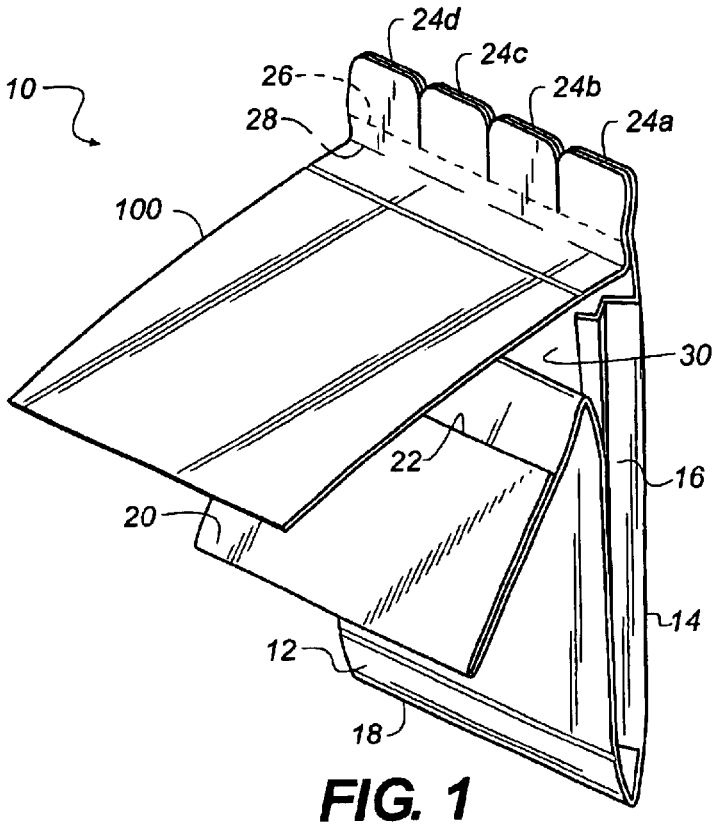
FIG. 1 is a perspective view of an envelope-type member, wallet-type member or holder for photographic products in accordance with the present invention.

Referring to the drawings, wherein like reference numerals represent identical or corresponding parts throughout the several views, FIG. 1 is a perspective view of an envelope or wallet-type member 10 for holding different types of photographic products in accordance with the present invention. In the photographic industry, an arrangement for holding photographic products as will be described in the present specification is generally known as a wallet. As shown in FIG. 1, wallet-type member 10 includes a first planar member 12 and a second planar member 14 which border each other at a fold line 18. At side ends of planar members 12 and 14 are expandable end member 16 only one of which is shown in FIG. 1. Thus, the combination of planar members 12 and 14 and side members 16 form an enclosure 30 for holding a first type of photographic product such as photographic prints therein. Extending from the top of first planar member 12 is a flap 20 which includes a storage slot 22. Storage slot 22 is sized to receive and hold a second type of photographic product such as photographic negatives therein.

In a first feature of the present invention as shown in FIG. 1, multiple tabs are attached to a top end of planar member 14. In the embodiment shown in FIG. 1, four tabs 24*a*, 24*b*, 24*c* and 24*d* extend along the top of wallet-type member 10 with a perforated or tear line 26 separating a top end of planar member 14 and tabs 24*a*–24*d*.

A second fold line 28 is provided below perforated or tear line 26 and a further flap 100 extends downward from the second fold line 28. Flap 30 is sized so that in a closed position as illustrated in FIG. 2, the enclosures formed by planar members 12, 14 end members 16 and storage slot 22 are covered.

Figure 2:
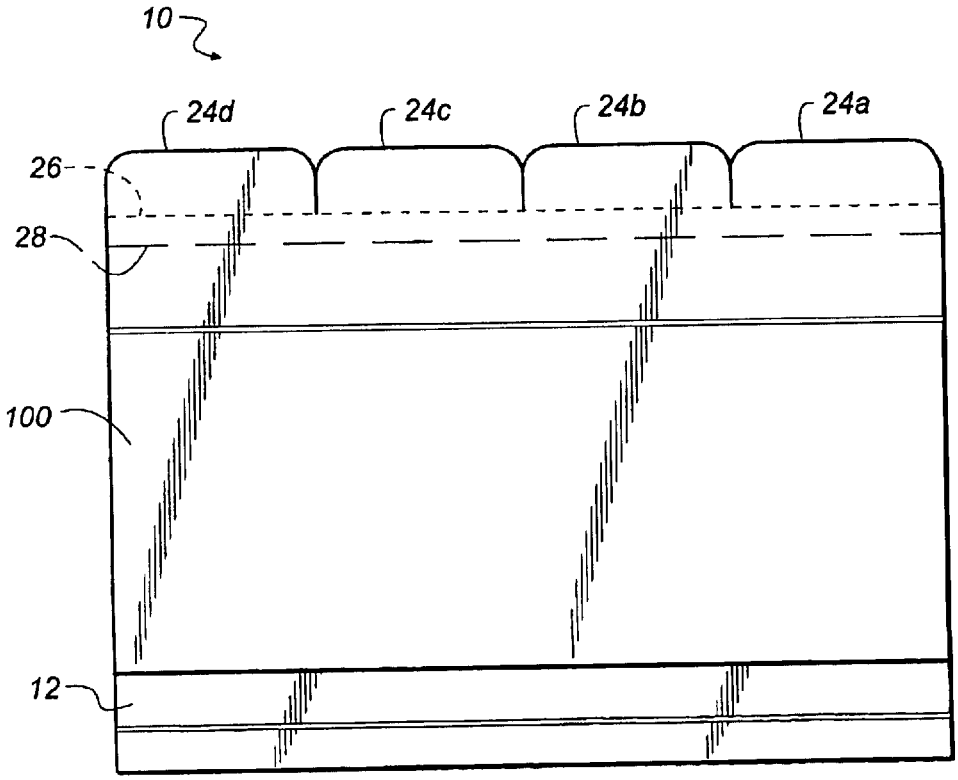
FIG. 2 is a planar view of one side of the wallet-type member of FIG. 1.

As illustrated in FIG. 1 and also in FIG. 2, a feature of the present invention is the provision of tabs 24*a*–24*d* along the top of wallet-type member 10 in a manner in which tabs 24*a*–24*d* extend along the full width of planar member 14. The tabs are connected to the top of planar member 14 by way of perforated or tear line 26.

Figure 3:
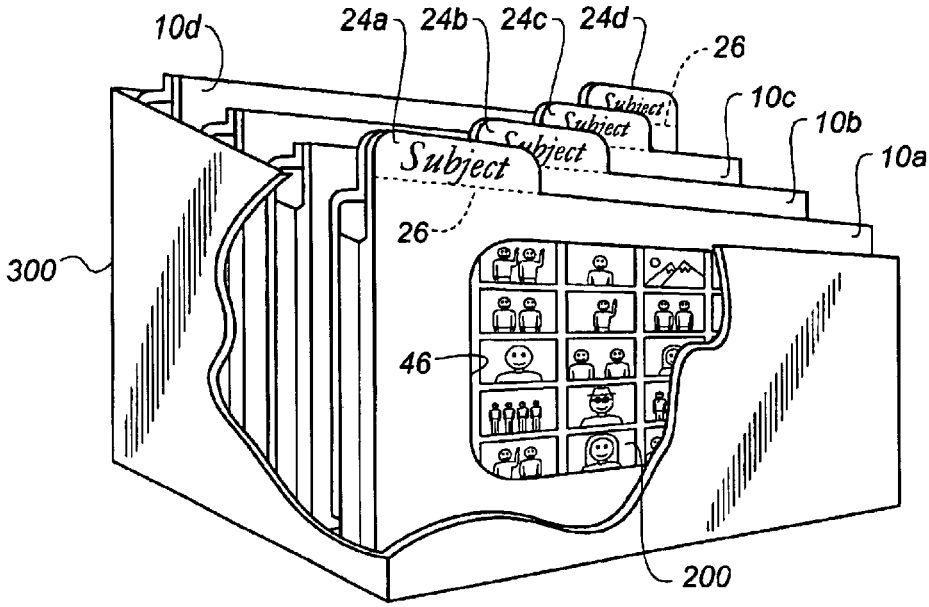
FIG. 3 is a perspective view showing the relationship between the wallet-type member and a storage box in accordance with a feature of the present invention.

As previously described, a customer who orders photographic prints will customarily receive the prints in a wallet or wallet-type member. With the arrangement of the present invention as illustrated in FIGS. 1 and 2, wallet-type member 10 would be returned to the customer with photographic prints inserted within enclosure 30 and negatives provided within storage slot 22. The provision of removable tabs 24*a*–24*d* permits a customer to identify the nature or content of the photographic prints by providing identifying information on any of tabs 24*a*–24*d*. Furthermore, the provision of tabs 24*a*–24*d* as shown with perforated or tear line 26 permits the customization of wallet-type member 10 by giving the customer the choice of which tabs 24*a*–24*d* to use and which tabs to remove. More specifically, in order to facilitate the storage and organization of photographic prints, a plurality of wallet-type members 10 can be provided within a storage box 300 as shown in FIG. 3. In order to identify the subject matter of the photographic prints in each of the wallet-type members, identifying information can be written on any of tabs 24*a*–24*d* by a customer. As the customer continues to add wallet-type members 10 to storage box 300, the customer can stagger or offset the location of tabs 24*a*–24*d* so as to permit an unobstructed view of each of the tabs 24*a*–24*d* while in box 300. The provision of multiple tabs 24*a*–24*d* as shown in FIG. 2 with perforated or tear line 26 thereon as also shown in FIG. 2 gives the customer the ability to select which of tabs 24*a*–24*d* is to be used in accordance with where the wallet-type member is to be located within storage box 300.

More specifically, and as shown in FIG. 3, in a first wallet-type member 10*a*, tabs 24*b*–24*d* can be removed by way of tear line 26 leaving only tab 24*a* thereon. If a second wallet-type member 10*b* is to be placed behind first wallet-type member 10*a* in storage box 300, tabs 24*a*, 24*c* and 24*d* can be removed leaving tab 24*b* on wallet-type member 10*b*. As wallet-type members 10*c* and 10*d* are added to box 300, wallet-type members 10*c* and 10*d* can be customized to respectively leave only tabs 24*c* and 24*d* thereon. Therefore, as shown in FIG. 3, tabs 24*a*–24*d* for each respective wallet-type member 10*a*–10*d* are in an offset relation and do not obstruct each other. If further wallet-type members are to be placed behind envelope 10*d*, the sequence as noted above is repeated to again create the offset relation shown in FIG. 3.

Figure 4:
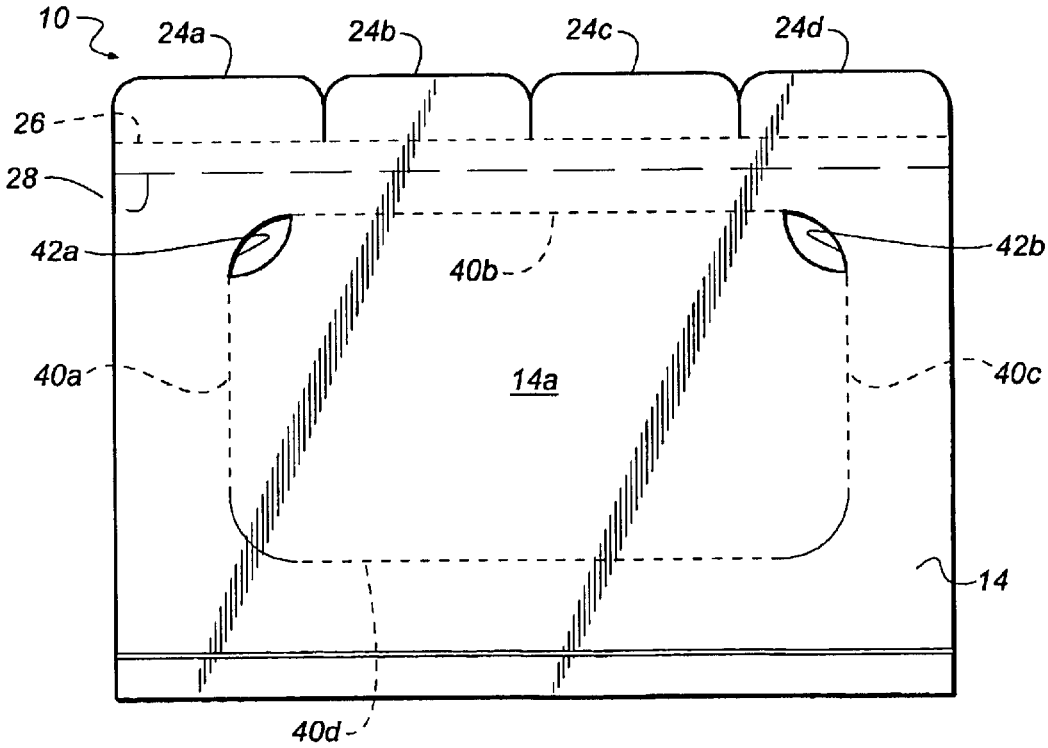
FIG. 4 is a planar view of a side of the wallet-type member opposite to the view of FIG. 2 illustrating a perforated or tear line for forming an opening on the wallet-type member in accordance with the present invention.
Figure 5:
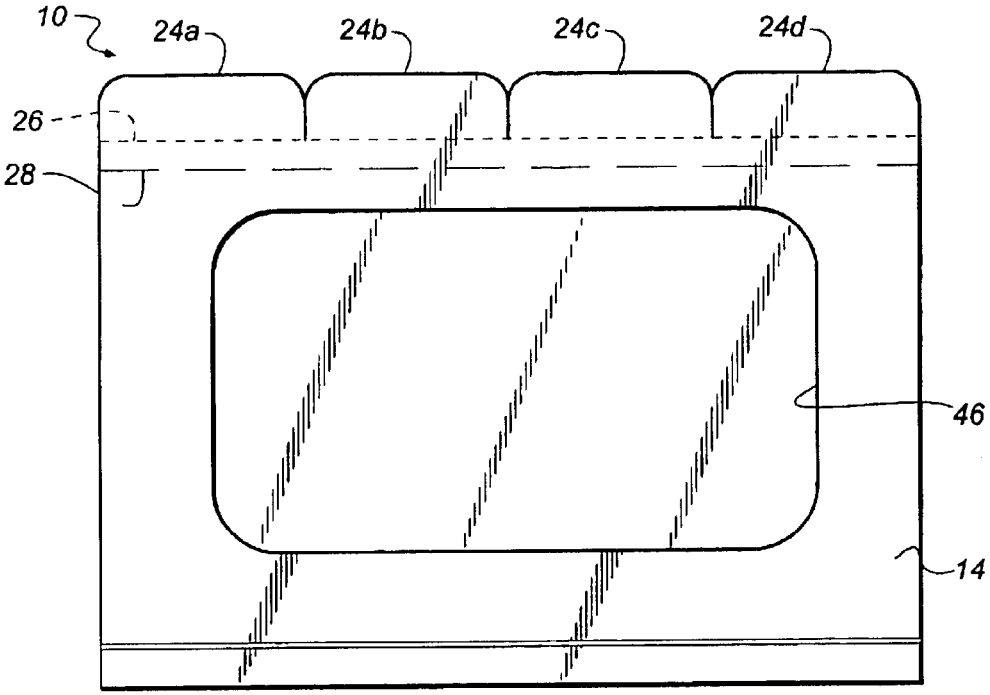
FIG. 5 is a view of the wallet-type member of FIG. 4 with the portion removed to reveal a picture-viewing opening.

In a further feature of the present invention, planar member 14 of wallet-type member 10 can be provided with a further perforated or tear line arrangement as shown in FIG. 4. In the example of FIG. 4, reference numerals 40*a*, 40*b*, 40*c* and 40*d* define the further perforated or tear line arrangement. In the example of FIG. 4, tear lines 40*a* and 40*c* and tear lines 40*b*and 40*d* are parallel to each other so as to define a continuous tear line in the form of a rectangle. Perforated or tear line 40*a*–40*d* defines a portion 14*a* on planar member 14 which is removable along tear line 40*a*–40*d* to form an opening 46 as shown in FIG. 5. For ease of manufacture, portion 14*a* is preferably made of the same material as wallet-type member 10 and is, therefore, preferably non-transparent. The removal of portion 14*a* along tear line 40*a*–40*d* can be facilitated by the use of apertures or openings 42*a*, 42*b* (FIG. 4) which can be sized to permit the insertion of a portion of a user's finger when the user desires to tear portion 14*a* from planar member 14.

Therefore, with the arrangement of the present invention as shown in FIG. 4, when a wallet-type member 10 having photographic prints therein is returned to a customer, wallet-type member 10 will include tear line 40*a*–40*d* as shown to define removable portion 14*a*, and optionally, apertures or openings 42*a*, 42*b*. With this arrangement, the customer simply has to remove portion 14*a* as shown along perforated or tear line 40*a*–40*d*. This creates opening 46 (FIG. 5) and provides the customer with an opportunity to place a desired photographic print adjacent to opening 46 so as to be viewable or displayed through opening 46. The photographic print placed at opening 46 would preferably be a photographic print which is representative of the prints stored in wallet-type member 10 and can more preferably be an index print 200 as shown in wallet-type member 10*a* of FIG. 3.

With this arrangement, the customer can easily view the first picture or the index print representative of the prints stored within wallet-type member 10. This provides the customer with a further way to distinguish wallet-type member 10 and thereby facilitates the storage, organization and location of multiple wallet-type members and photographs. The combination of opening 46 as well as tabs 24*a*–24*d* as shown further provides the customer with the combination of a visual representation or display of a photographic print which is representative of the photographic prints stored in wallet-type member 10, as well as identification information provided on a selected tab 24*a*–24*d*. Further, by presenting the customer with multiple tabs 24*a*–24*d* with perforated or tear line 26 between the tab and planar member 14, the ability to customize which tab the customer desires to use so as to facilitate the viewing of the tab within storage box 300 is also realized. As shown in FIG. 4, removable portion 14*a* and tabs 24*a*–24*d* are preferably provided on the same planar member 14 so as to facilitate the viewing of tabs 24*a*–24*d* and opening 46 at the same time.

Figure 6:
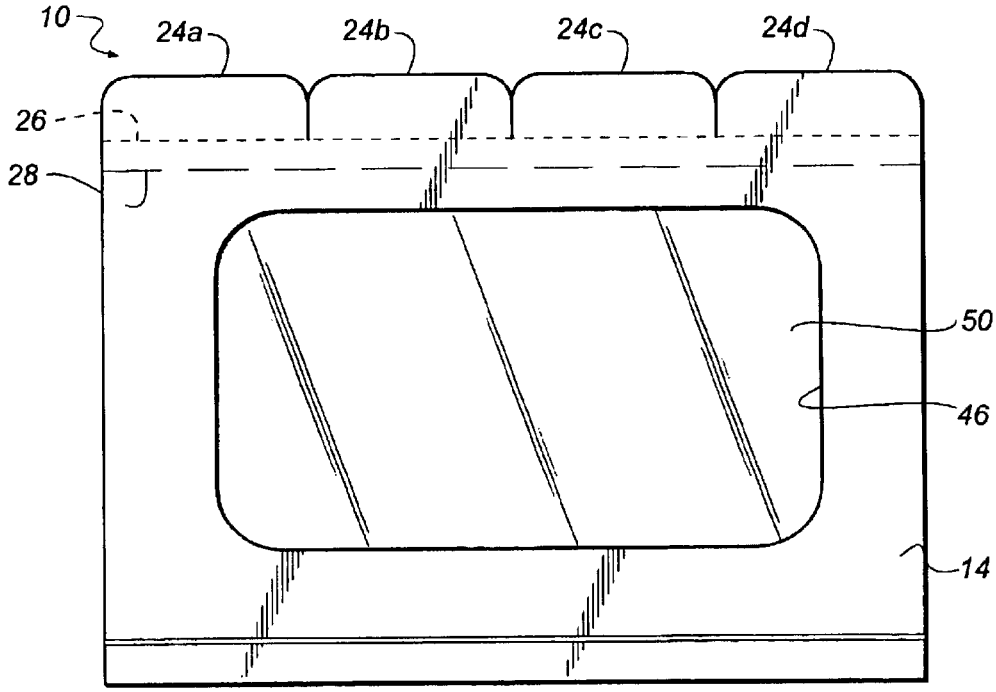
FIG. 6 is a view of the wallet-type member in accordance with the present invention in which the opening has a transparent window attached thereon.

In a further embodiment, as shown in FIG. 6 a transparent sheet or window 50 can be adhered to opening 46. As an example, transparent sheet 50 can be made of a plastic material. With this arrangement, after portion 14*a* is removed, opening 46 would be revealed, and transparent sheet 50 would be positioned within opening 46 so as to provide protection for the first print adjacent to opening 46.

In a still further embodiment, wallet-type member 10 can be delivered to the customer in the manner shown in FIG. 5. That is, wallet-type member 10 can be delivered with opening 46 already thereon and, for example, an index print at the opening. Thereafter, the customer simply has to decide which of tabs 24*a*–24*d* to use for storage and identification while maintaining the ability to pick which photographic print is to be placed at opening 46. As a further option with this embodiment where opening 46 is already provided on the wallet-type member, transparent sheet 50 can be provided at opening 46 as in FIG. 6. Again, transparent sheet 50 is useful in protecting the print at opening 46.

Figure 7:
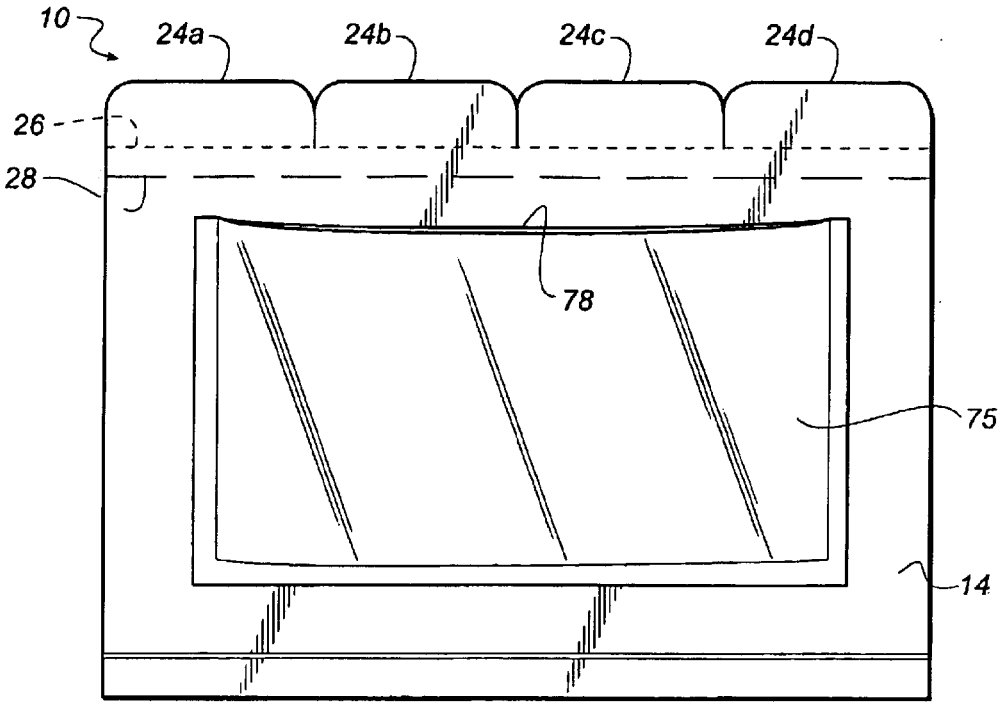
FIG. 7 is a view of the wallet-type member in accordance with the present invention, in which a transparent sheet forms a pocket on the wallet-type member.

In a further embodiment of the present invention as shown in FIG. 7, a transparent sheet 75 can be adhered along three sides onto planar member 14 to form a pocket 78. With this arrangement, when a wallet-type member 10 is provided to the customer with photographic prints therein, the customer can choose which photographic print to place within pocket 78 and again, decide which tab 24*a*–24*d* to use and what information to provide on the tab.

In a still further embodiment, the wallet-type member of FIG. 7 can be provided with a non-transparent removable portion provided over transparent sheet 78. Thereafter, the customer simply removes the removable portion to reveal the pocket formed by transparent sheet 78. Thereafter, the customer decides which photographic print to place within the pocket and which tab to utilize.

Referring back to FIG. 4, although a rectangle removable portion 14*a* is shown bordered by perforated or tear line 40*a*–40*d*, the present invention is not limited to a rectangular opening. It is recognized that removable portion 14*a* can be of any shape or size, for example, removable portion 14*a* can take the form of a square, a parallelogram, a circle, a half-moon, a triangle or any other geometric shape which is sized so as to at least provide enough of a view of the photographic print provided adjacent to the opening.

As described above, opening 46 permits a user to display a desired photographic print or index print on or in wallet-type member 10 which is representative of the prints stored in photographic envelope 10. Further, tabs 24*a*–24*d* permit a user to provide identifying information on the wallet-type member, and the provision of perforated or tear line 26 permits the user to remove a selected tab and leave a desired tab on the wallet-type member based on where the user decides to place the wallet-type member within storage box 300.

A further advantage of the perforated tab and perforated opening of the present invention is that the wallet-type member can be utilized in high speed automated packaging environments which are utilized in wholesale photofinishing labs.

Figure 8:
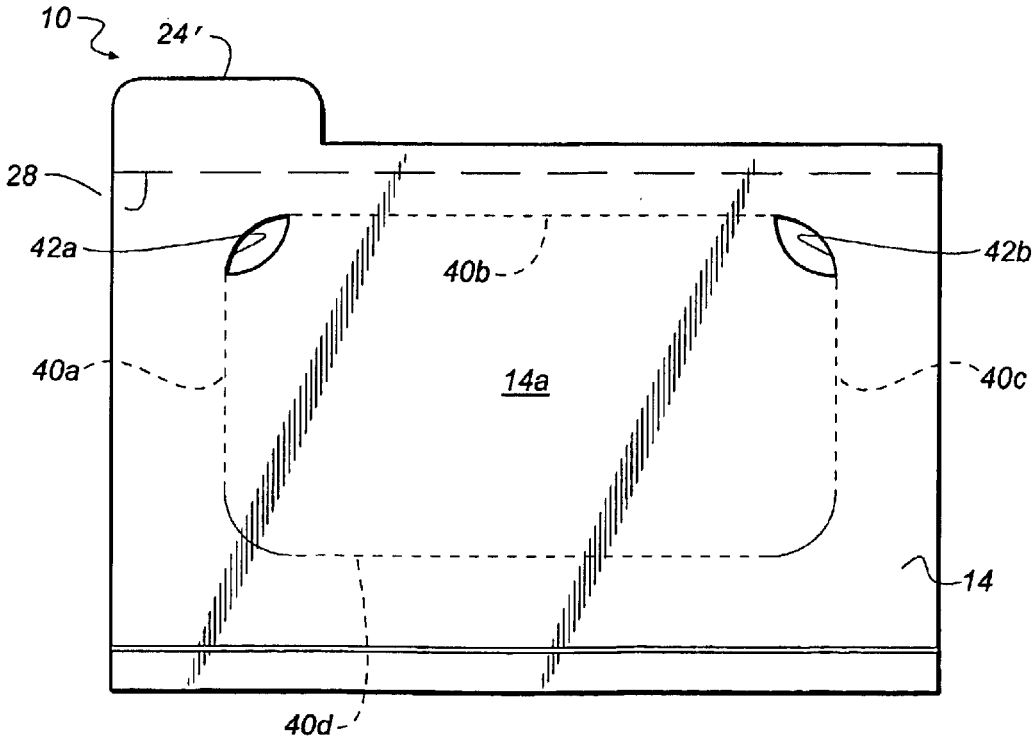
FIG. 8 is a view of a further embodiment of a wallet-type member in accordance with the present invention.

Also, although four tabs 24*a*–24*d* are shown, the present invention is not limited thereto. In a further embodiment of the present invention, wallet-type member 10 includes a single tab 24' and removable portion 14*a* as shown in FIG. 8. In this embodiment, a perforated or tear line between tab 24' and the top of wallet-type member 10 is not necessary. This embodiment permits the user to remove portion 14*a* to display a desired photographic print and provide identifying information on the single tab.

Additionally, the number of tabs can be varied and tabs of various widths can be provided on wallet-type member 10. For example, and with reference to FIGS. 2 and 4, it is shown that the width of each of tabs 24*a*–24*d* match the width of wallet-type member 10. It is possible to practice the present invention with two removable tabs wherein one tab matches the width of tabs 24*a*and 24*b* and the second tab matches the width of tabs 24*c* and 24*d*.

Therefore, the present invention provides for a wallet-type member which facilitates the storage, organization and location of photographic prints. In one embodiment of the wallet-type member of the present invention, tabs are removably provided on the end of the envelope in a manner in which selected tabs can be removed so as to customize the position of the tab on the envelope. In a further embodiment, an opening can be provided on the envelope so as to display a selected photographic print or index print representative of the prints stored in the envelope. Further, this opening can be utilized in combination with a single tab. In a further feature of the present invention, the tab or tabs and the opening are provided on the same planar member of the wallet-type member so as to enable the viewing of both the tab or tabs and the displayed photographic print at the same time.

The invention has been described in detail with particular reference to certain preferred embodiments thereof, but it will be understood that variations and modifications can be effected within the spirit and scope of the invention.

What is claimed is:

1. A holder for holding at least photographic prints, the holder comprising:

a first planar member attached to a second planar member through a first fold line;

first and second expandable end members at side ends of the first and second planar members, such that the first and second planar members and said first and second expandable end members define an enclosure for holding at least photographic prints;

a storage slot sized to receive and hold negatives therein, said storage slot being attached to an end of said second planar member so as to hang over an outer surface of said second planar member;

at least two tabs attached to a top end of said first planar member, wherein a first perforated line is defined between the top end of said first planar member and said at least two tabs to permit a removal of each of said tabs from the top end of said first planar member; and a flap extending from said first planar member, said flap extending from a second fold line on said first planar member which is located below said first perforated line and said at least two tabs, said flap extending over said storage slot and being movable to at least a closed position to cover said enclosure and said storage slot, such that in said closed position of said flap, said second fold line remains located below said first perforated line and said at least two tabs.

2. A holder according to claim 1, further comprising four of said tabs provided at the top end of said first planar member, said first perforated line being provided between said four tabs and the top end of said first planar member.

3. A holder according to claim 2, wherein a combined width of said four tabs is equal to a width of said first planar member.

4. A holder according to claim 1, further comprising:

a transparent material provided on an outer surface of said first planar member, wherein a pocket is defined between said transparent material and said first planar member to permit a viewing of a photographic print inserted into said pocket.

5. A holder according to claim 4, wherein said transparent material is a plastic member.

6. A holder according to claim 1, further comprising:

second and third parallel perforated lines and fourth and fifth parallel perforated lines interconnected to said second and third parallel perforated lines on said first planar member;

wherein:

a portion of said planar member provided within said second through fifth perforated lines is removable at said second through fifth perforated lines to form a print viewing opening; and a selected photographic print provided within said enclosure is viewable through said print viewing opening when said portion of said first planar member is removed.

7. A holder according to claim 6, further comprising at least apertures along said second through fifth perforated lines which are sized to permit a user to insert a portion of a finger and remove the portion of the planar member to form the print viewing opening.

8. A holder according to claim 1, further comprising:

a portion within said first planar member that is defined by second through fifth perforated lines, said portion being removable at said second through fifth perforated lines to form a picture viewing opening on said first planar member to permit a viewing of a photographic print in said enclosure through said picture viewing opening.

9. An arrangement for holding photographic products, the arrangement comprising:

a first holding area for holding a first type of photographic product, said first holding area having a first planar member and a second planar member;

at least two tabs removably provided on one of said first and second planar members of said first holding area; and a flap extending from said one of said first and second planar members, said flap extending from a fold line on said one of said first and second planar members which is located below said at least two tabs, said flap being movable to at least a closed position to cover at least said first holding area, such that in said closed position of said flap, said fold line remains located below said at least two tabs.

10. An arrangement according to claim 9, further comprising four of said tabs removably provided on said one of said first and second planar members.

11. An arrangement according to claim 9, further comprising:

a transparent plastic window provided on said one of said first and second planar members of said first holding area, said transparent plastic window forming a pocket on said first holding area for holding said first type of photographic product therein in a visible manner.

12. An arrangement according to claim 9, further comprising:

a portion on said one of said first and second planar members that is defined by a tear line, said portion being removable through said tear line to form a picture viewing opening on said one of said first and second planar members and permit a viewing of at least one of said first type of photographic product in said first holding area through said picture viewing opening.

13. An arrangement according to claim 12, further comprising at least one aperture provided along said tear line to facilitate the removal of said portion.

14. An arrangement according to claim 9, further comprising an opening on said one of said first and second planar members and a transparent sheet covering said opening, such that at least one of said first type of photographic product in said first holding area is viewable through said transparent sheet.

15. An arrangement according to claim 9, further comprising:

a second holding area hanging from an end of the other of said first and second planar members of said first holding area, said second holding area being sized to hold a second type of photographic product therein.

16. An arrangement according to claim 15, wherein said first type of photographic product is a photographic print and said second type of photographic product is a negative of said photographic print.

17. A method of storing and organizing at least photographic prints, the method comprising the steps of:

inserting photographic prints into a first holding area defined by at least first and second planar members; and placing at least two tabs at an end of one of said first and second planar members, wherein a first tear line is provided between the at least two tabs and the end of said one of said first and second planar members to permit a removal of a selected one of said tabs, such that said at least two tabs define a top end of a wallet-type member formed by enclosing at least said first holding area with a flap, said flap having a first end attached to one of said first and second planar members and said tabs, and a second free end, said tabs being sized to permit the addition of identifying information thereon, said identifying information being related to at least the photographic prints held in said first holding area.

18. A method according to claim 17, comprising the further step of:

permitting a viewing of one of said photographic prints in said first holding area by providing a removable portion on said one of said first and second planar members, said removable portion being surrounded by a second tear line and permitting the removal of said portion to form an opening in said one of said first and second planar members, said opening being sized to permit a viewing of a photographic print in said first holding area.

19. A method according to claim 17, comprising the further step of:

inserting negatives of said photographic prints into a second holding area which extends from an end of the other of said first and second planar members.

20. An arrangement for storing and organizing at least photographic prints, the arrangement comprising:

a storage member adapted to store photographic prints, the storage member comprising a planar member having at least one tab extending therefrom, said storage member having a flap which is movable between at least an open position to permit access to an interior of said storage member and a closed position to close said interior of said storage member, said at least one tab defining a top end of said storage member in said open and closed positions of said flap; and a removable portion on said planar member which is removable to form an opening in said planar member, said opening being sized to permit a viewing of a photographic print in said storage member.

21. An arrangement according to claim 20, further comprising a transparent sheet which extends across said opening.

22. An arrangement according to claim 20, further comprising a box which is sized to hold a plurality of said storage member, said at least one tab being sized to permit the addition of identifying information thereon to distinguish photographs in one storage member from photographs in a second storage member.

23. An arrangement for storing and organizing at least photographic prints, the arrangement comprising:

an envelope having a holding section adapted to store photographic prints, the envelope comprising at least two tabs removably provided on said envelope, said at least two tabs defining top end of said envelope in both an opened state and a closed state of said envelope; and a transparent window provided on said envelope, said transparent window forming a pocket on said envelope to permit a viewing of a photographic print inserted in said pocket.

24. An arrangement for storing and organizing at least photographic prints, the arrangement comprising:

a storage section adapted to store photographic prints, the storage section comprising at least two tabs removably provided on said storage section, said storage section having flap which is movable between an open position to permit access to an interior of said storage section and a closed position to close said interior of said storage section, said at least two tabs defining a too end of said storage section in said open and closed positions of said flap; and a removable portion on a planar member of said storage section, said removable portion being removable to form an opening in said planar member, said opening being sized to permit a viewing of a photographic print in said storage section.

25. An arrangement for storing and organizing at least photographic prints, the arrangement comprising:

a wallet-type member adapted to store photographic prints, the wallet-type member comprising at least two tabs removably provided on said wallet-type member, said at least two tabs defining a top end of said wallet-type member in both an open state and a closed state of said wallet-type member; and an opening provided on a planar member of said envelope, said opening being sized to permit a viewing of a photographic print in said envelope.

26. An arrangement according to claim 25, further comprising a transparent window covering said opening.

27. A method of delivering at least photographic prints to a customer, the method comprising the steps of:

inserting photographic prints into a wallet-type member; and placing at least two tabs at a top end of said wallet-type member, wherein a first tear line is provided between the at least two tabs and the top end of said wallet-type member to permit a removal of a selected one of said tabs, said at least two tabs defining top end of said wallet-type member when said wallet-type member is opened to permit insertion of the photographic prints and when said wallet-type member is closed, said tabs being sized to permit the addition of identifying information thereon by the customer, said identifying information being related to at least the photographic prints held in wallet-type member.

28. A method according to claim 27, comprising the further step of:

permitting a visual display of one of said photographic prints in said wallet-type member by providing a removable portion on a planar member of said wallet-type member, said removable portion being surrounded by a second tear line and permitting the removal of said portion by the customer to form an opening in said planar member, said opening being sized to permit the visual display of a photographic print in said wallet-type member.

29. A method according to claim 27, comprising the further step of:

permitting a visual display of one of said photographic prints by providing a transparent window on a planar member of said wallet-type member, said transparent window forming a pocket and permitting the visual display of a photographic print inserted in said pocket.

30. A method according to claim 27, comprising the further step of:

permitting a visual display of one of said photographic prints in said wallet-type member by providing an opening on a planar member of said wallet-type member.

31. A method according to claim 30, comprising the further step of providing a transparent window across the opening.

32. A method of delivering at least photographic prints to a customer, the method comprising the steps of:

inserting photographic prints into a wallet type member;

permitting a visual display of one of said photographic prints in said wallet-type member by providing a removable portion on a planar member of said wallet type member, said removable portion being surrounded by a tear line and permitting the removal of said portion by the customer to form an opening in said planar member, said opening being sized to permit the visual display of a photographic print in said wallet-type member; and placing a tab on said planar member, such that said tab defines a top end of said wallet-type member when said wallet-type member is opened to permit insertion of the photographic prints and when said wallet-type member is closed.

33. A holder adapted to hold at least photographic prints, the holder comprising:

a wallet-type member adapted-to hold photographic prints;

a removable portion on a planar member of said wallet-type member, said removable portion being removable to form an opening in said planar member, said opening being sized to permit a viewing of a photographic print in said wallet-type member; and a tab provided on said planar member, said tab defining a top end of said wallet-type member in both an open state and a closed state of said wallet-type member.

34. A holder according to claim 33, wherein said removable portion is surrounded by a tear line.

* * * * *

UNITED STATES PATENT AND TRADEMARK OFFICE

CERTIFICATE OF CORRECTION

PATENT NO. : 6,959,508 B2
APPLICATION NO. : 10/600214
DATED : November 1, 2005
INVENTOR(S) : Rachel L. Watkins et al.

It is certified that error appears in the above-identified patent and that said Letters Patent is hereby corrected as shown below:

| | |
|---|---|
| Claim 24 - Column 10 - Line 35 | Replace “too end” with –top end-- |

Signed and Sealed this

Twenty-second Day of August, 2006

JON W. DUDAS
*Director of the United States Patent and Trademark Office*